US007745714B2

(12) United States Patent
Matsumoto et al.

(10) Patent No.: US 7,745,714 B2
(45) Date of Patent: Jun. 29, 2010

(54) RECORDING OR PLAYBACK APPARATUS AND MUSICAL PIECE DETECTING APPARATUS

(75) Inventors: Satoru Matsumoto, Izumi (JP); Yuji Yamamoto, Yawata (JP); Tatsuo Koga, Daito (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 73 days.

(21) Appl. No.: 12/053,647

(22) Filed: Mar. 24, 2008

(65) Prior Publication Data

US 2008/0236368 A1 Oct. 2, 2008

(30) Foreign Application Priority Data

Mar. 26, 2007 (JP) ..... 2007-078956

(51) Int. Cl.
*G10H 1/00* (2006.01)

(52) U.S. Cl. ..... 84/600; 84/601; 700/94

(58) Field of Classification Search ..... 84/600–602; 700/94

See application file for complete search history.

(56) References Cited

U.S. PATENT DOCUMENTS 5,233,484 A * 8/1993 Nagasawa et al. ..... 360/64
5,402,277 A * 3/1995 Nagasawa et al. ..... 360/64
5,712,953 A * 1/1998 Langs ..... 704/214
6,169,241 B1 * 1/2001 Shimizu ..... 84/605
6,242,681 B1 * 6/2001 Daishoji ..... 84/604
6,570,991 B1 * 5/2003 Scheirer et al. ..... 381/110
6,998,527 B2 * 2/2006 Agnihotri ..... 84/609
7,120,576 B2 * 10/2006 Gao ..... 704/208
7,179,980 B2 * 2/2007 Kirkeby et al. ..... 84/600
7,256,340 B2 * 8/2007 Okazaki et al. ..... 84/604
7,277,852 B2 * 10/2007 Iyoku et al. ..... 704/236
7,315,899 B2 * 1/2008 Dunning et al. ..... 709/232
7,336,890 B2 * 2/2008 Lu et al. ..... 386/96
7,346,516 B2 * 3/2008 Sall et al. ..... 704/500
7,544,881 B2 * 6/2009 Makino et al. ..... 84/615
7,558,729 B1 * 7/2009 Benyassine et al. ..... 704/226
2002/0120456 A1 * 8/2002 Berg et al. ..... 704/278
2003/0101050 A1 * 5/2003 Khalil et al. ..... 704/216
2003/0171936 A1 * 9/2003 Sall et al. ..... 704/500
2003/0229537 A1 * 12/2003 Dunning et al. ..... 705/10
2004/0069118 A1 * 4/2004 Okazaki et al. ..... 84/603

(Continued)

FOREIGN PATENT DOCUMENTS

JP 2004-258659 A1 9/2004

*Primary Examiner*—David S. Warren
(74) *Attorney, Agent, or Firm*—Marvin A. Motsenbocker; Mots Law, PLLC

(57) ABSTRACT

Provided is a recording or playback apparatus capable of separating a musical piece from an audio including the musical piece and a speech through a simple arithmetic process. A cut point detector detects, as a cut point, a time point at which an audio signal level or an amount of change in the audio signal level is not lower than a predetermined value. A frequency characteristic amount calculator calculates a characteristic amount in a frequency area of the audio signal only at each cut point and in its proximity. A cut point judging unit judges an attribute of the cut point on a basis of the calculated characteristic amount of the frequency. A music section detector detects a start and end points of each music section on a basis of the attribute and an interval between sampling points.

1 Claim, 5 Drawing Sheets

| TIME | AMOUNT OF CHANGE | ATTRIBUTE |
|---|---|---|
| T1 | XXXX | NON MUSICAL PIECE |
| T2 | XXXX | MUSICAL PIECE |
| T3 | XXXX | MUSICAL PIECE |
| T4 | XXXX | MUSICAL PIECE |
| T5 | XXXX | NON MUSICAL PIECE |
| T6 | XXXX | MUSICAL PIECE |
| T7 | XXXX | NON MUSICAL PIECE |
| T8 | XXXX | MUSICAL PIECE |
| T9 | XXXX | MUSICAL PIECE |
| T10 | XXXX | NON MUSICAL PIECE |
| T11 | XXXX | NON MUSICAL PIECE |
| ⋮ | ⋮ | ⋮ |

U.S. PATENT DOCUMENTS

2004/0165730 A1* 8/2004 Crockett ..... 381/56
2004/0167767 A1 8/2004 Xiong et al.
2005/0016360 A1* 1/2005 Zhang ..... 84/600
2005/0169114 A1* 8/2005 Ahn ..... 369/7
2006/0074667 A1* 4/2006 Saffer ..... 704/257
2006/0081118 A1* 4/2006 Okazaki et al. ..... 84/604
2006/0085188 A1* 4/2006 Goodwin et al. ..... 704/245
2007/0051230 A1* 3/2007 Hasegawa ..... 84/616
2007/0106406 A1* 5/2007 Makino et al. ..... 700/94
2008/0097756 A1* 4/2008 De Lange et al. ..... 704/226
2008/0236368 A1* 10/2008 Matsumoto et al. ..... 84/611
2009/0088878 A1* 4/2009 Otsuka et al. ..... 700/94

* cited by examiner

FIG. 4

| TIME | AMOUNT OF CHANGE | ATTRIBUTE |
|---|---|---|
| T1 | XXXX | NON MUSICAL PIECE |
| T2 | XXXX | MUSICAL PIECE |
| T3 | XXXX | MUSICAL PIECE |
| T4 | XXXX | MUSICAL PIECE |
| T5 | XXXX | NON MUSICAL PIECE |
| T6 | XXXX | MUSICAL PIECE |
| T7 | XXXX | NON MUSICAL PIECE |
| T8 | XXXX | MUSICAL PIECE |
| T9 | XXXX | MUSICAL PIECE |
| T10 | XXXX | NON MUSICAL PIECE |
| T11 | XXXX | NON MUSICAL PIECE |
| ⋮ | ⋮ | ⋮ |

FIG. 5

MUSICAL PIECE A

| TIME | AMOUNT OF CHANGE | ATTRIBUTE |
|---|---|---|
| T1 | XXXX | NON MUSICAL PIECE |
| T2 | XXXX | MUSICAL PIECE |
| T3 | XXXX | MUSICAL PIECE |
| T4 | XXXX | MUSICAL PIECE |
| T5 | XXXX | NON MUSICAL PIECE |

MUSICAL PIECE B

| TIME | AMOUNT OF CHANGE | ATTRIBUTE |
|---|---|---|
| T7 | XXXX | NON MUSICAL PIECE |
| T8 | XXXX | MUSICAL PIECE |
| T9 | XXXX | MUSICAL PIECE |
| T10 | XXXX | NON MUSICAL PIECE |

RECORDING OR PLAYBACK APPARATUS AND MUSICAL PIECE DETECTING APPARATUS

CROSS REFERENCE TO RELATED APPLICATIONS

This application claims priority based on 35 USC 119 from prior Japanese Patent Application No. P2007-078956 filed on Mar. 26, 2007, the entire contents of which are incorporated herein by reference.

BACKGROUND OF THE INVENTION

1. Field of the Invention

The present invention relates to an apparatus which detects music (musical piece) sections from an audio including speech sections and music sections in a mixed manner.

2. Description of Related Art

In general, an aired audio often includes sections carrying speeches of an announcer and music sections in a mixed manner. When a listener wishes to record his/her favorite musical piece while listening to the audio, the listener has to manually start recording the musical piece at a timing when the musical piece begins, and to manually stop recording the musical piece at a timing when the musical piece ends. These manual operations are troublesome for the listener. Moreover, if a listener suddenly decides to record a favorite musical piece which is aired, it is usually impossible to thoroughly record the musical piece from its beginning without missing any part. In such case, it is effective to record an entire aired program first, and then extract the favorite musical piece from the recorded program by editing. This editing becomes easier by separating music sections from the aired program beforehand and by playing back only the separated music sections.

To this end, a technology for automatically separating music sections and speech sections from each other by analyzing characteristics of each of the sections. A technology disclosed by Japanese Patent Application Laid-Open Publication No. 2004-258659 is for separating a musical piece and a speech from each other by using characteristic amounts in terms of frequencies such as mel-frequency cepstral coefficients (MFCCs). However, the technology disclosed by the Publication No. 2004-258659 has a problem that a process for calculating the characteristic amount in a frequency area of an audio signal becomes vast because the process is so complicated that the workload for the process becomes large.

SUMMARY OF THE INVENTION

An aspect of the invention provides an apparatus implementing at least recording or playback that detects a music section from an audio signal. The apparatus comprises: a cut point detector configured to detect a time point as a cut point where a level of an audio signal or an amount of change in the audio signal level is equal to or more than a predetermined value; a frequency characteristic amount calculator configured to calculate a characteristic amount in a frequency area of the audio signal; a cut point judging unit configured to judge an attribute of the cut point on a basis of the calculated characteristic amount in a frequency; and a music section detector configured to detect a start point and an end point of a music section on a basis of the attribute and an interval between sampling points.

Another aspect of the invention provides an apparatus implementing at least recording or playback that detects a music section from an audio signal. The apparatus comprises:

a cut point detector configured to detect a time point as a cut point where a level of an audio signal level or an amount of change in the audio signal level is equal to or more than a predetermined value; a frequency characteristic amount calculator configured to calculate a characteristic amount in a frequency area of the audio signal; and a music section detector configured to detect a start point and an end point of each music section on a basis of the calculated characteristic amount of the frequency and information on the detected cut point.

Still another aspect of the invention provides a musical piece detecting apparatus that detects a musical piece from an inputted audio. The apparatus comprises: an audio power calculator configured to calculate an audio power from an inputted audio signal; a cut point detector configured to detect a time point as a cut point where a level of an audio signal level or an amount of change in the audio signal level is equal to or more than a predetermined value on a basis of the audio power, the cut point detector configured to output time information on the cut point; a frequency characteristic amount calculator configured to calculate a characteristic amount in a frequency area at the detected cut point of the inputted audio signal; a likelihood calculator configured to calculate a likelihood between the characteristic amount and reference data on the musical piece; a cut point judging unit configured to judge, on a basis of the likelihood, whether or not the audio signal at the cut point is the musical piece; a time length judging unit configured to judge, on a basis of the time information on the cut point, a result of the judgment made by the cut point judging unit, the time length judging unit judging, on the basis of the time information on the cut point, whether or not a section between sections not judged as musical pieces lasts for a predetermined time length or longer; and a music section detector configured to detect a music section on a basis of a result of the judgment made by the time length judging unit.

The recording or playback apparatus is capable of separating the musical piece from the audio consisting of the musical piece and the speech though a simple arithmetic process.

BRIEF DESCRIPTION OF THE DRAWINGS

FIG. 4 shows a table stored in a temporary storage memory.

FIG. 5 shows a final table rewritten in the temporary storage memory.

DETAILED DESCRIPTION OF EMBODIMENT

Figure 1:
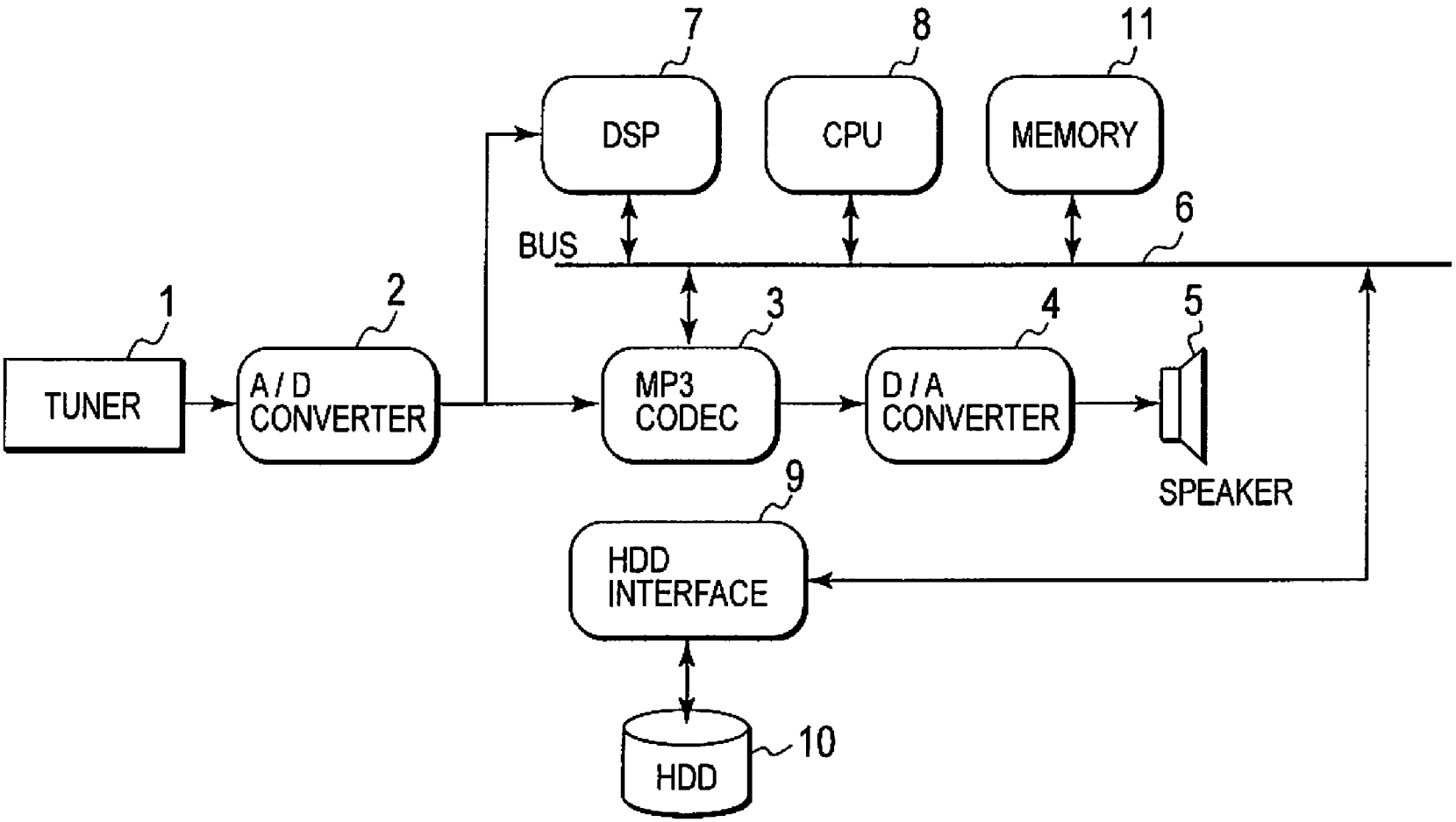
FIG. 1 is a configuration diagram illustrating a musical piece detecting function in a recording or playback apparatus according to an embodiment of the present invention.

Descriptions will be provided hereinbelow for an embodiment with reference to the drawings. FIG. 1 is a configuration diagram illustrating a musical piece detecting function in a recording or playback apparatus according to the embodiment. As shown in FIG. 1, the recording or playback apparatus according to the present embodiment selects, and receives, a broadcast signal for a television program, a radio program or the like, as well as thus demodulates the broadcast signal to an audio signal. A/D (analog-to-digital) converter 2 converts an analog audio signal selected by tuner 1 to a digital signal.

MPEG audio layer-3 (MP3) codec 3 includes an encoder function and a decoder function. The encoder function encodes the digital audio data, and thus generates compressed coded data, as well as subsequently outputs the compressed coded data along with time information. The decoder function decodes the coded data. D/A (digital-to-analog) converter 4 converts the digital audio data, which is decoded by MP3 codec 3, to analog signal data. Subsequently, this analog signal data is inputted into speaker 5 via an amplifier, whose illustration is omitted from FIG. 1.

On a basis of the audio signal, DSP (digital signal processor) 7 calculates an audio power obtained by raising a value representing the amplitude of the audio signal to the second power for the purpose of detecting an audio signal level. In addition, DSP 7 calculates an amount of change in the audio power in order to detect an amount of change in the audio signal level. Furthermore, DSP 7 defines, as a cut point, a timing at which the amount of change in the audio power is not smaller than a predetermined value, and thus detects the cut point. Moreover, DSP 7 calculates a characteristic amount in a frequency area, an MFCC, for example, only at each cut point and in its proximity. Then, DSP 7 calculates a likelihood between the characteristic amount and an MFCC calculated on a basis of a sample audio signal.

Through bus 6, CPU (central processing unit) 8 controls the overall operation of the recording or playback apparatus according to the present embodiment. In addition, CPU 8 performs things such as a process for assuming whether the cut point belongs to the start point or the end point of the musical piece. HDD (hard disc drive) 10 is a large-capacity storage in which the coded data and the time information is stored via HDD interface 9 of an ATA (advanced technology attachment) interface. Memory 11 has a function of storing the execution program, and of having data generated through the arithmetic process stored temporarily, as well as of delaying the audio data for a predetermined time length right after the audio data is converted from analog to digital. It should be noted that various pieces of data are transmitted to, and received from, MP3 codec 3, DSP 7, CPU 8, HDD interface 9 and memory 11 via bus 6.

Figure 2:
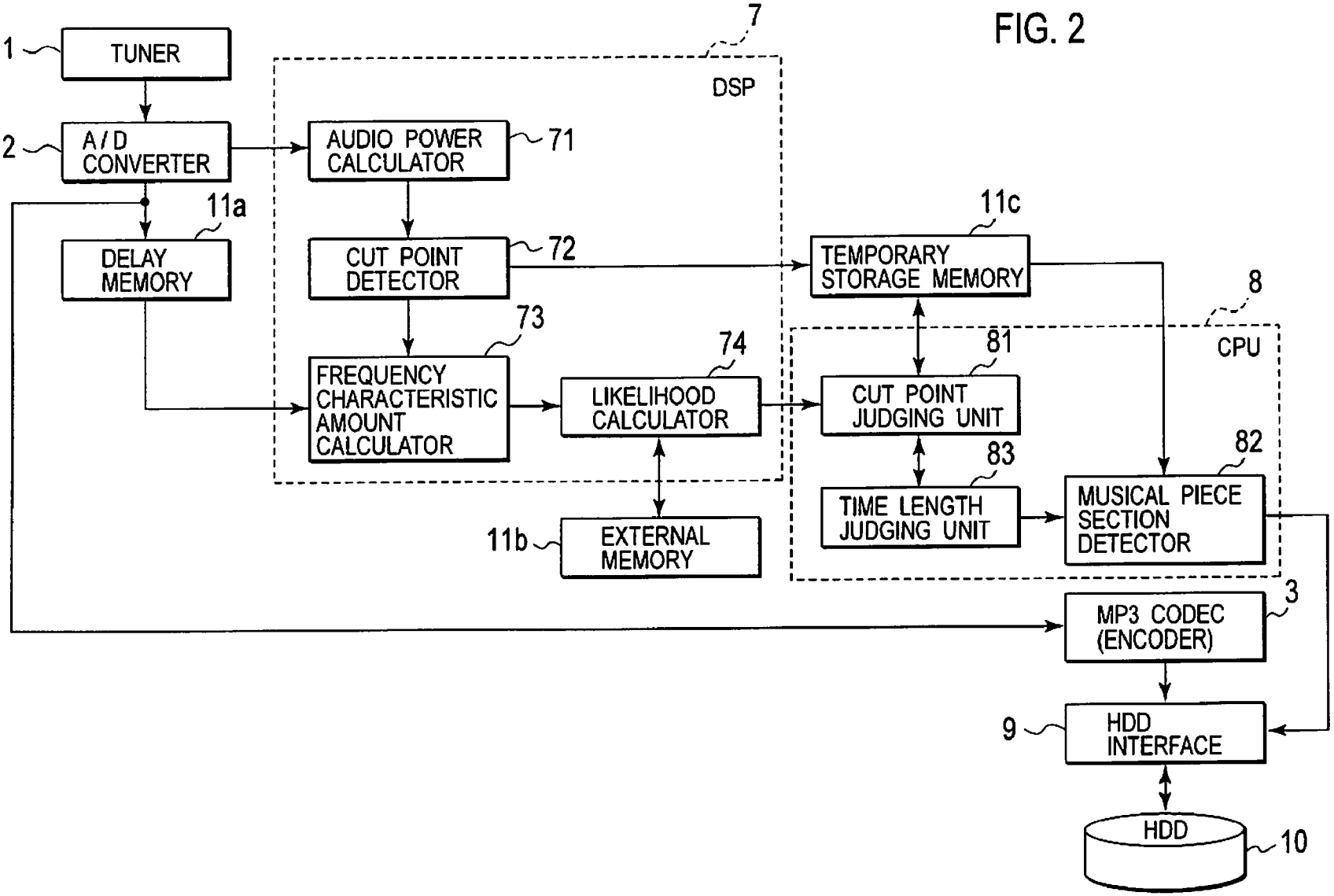
FIG. 2 is a functional block diagram illustrating a part of the recording or playback apparatus according to the embodiment.

FIG. 2 is a functional block diagram showing a part of the recording or playback apparatus according to the present embodiment. As shown in FIG. 1, the recording or playback apparatus according to the present embodiment inputs the audio signal tuned in to by tuner 1 to A/D converter 2, and thus converts the audio signal from analog to digital. Subsequently, the recording or playback apparatus inputs the digital-converted audio signal along with the time information to the MP3 codec 3, and thus compresses and encodes the digital-converted audio signal into MP3 data, as well as continuously records the MP3 data along with the time information in HDD 10 via HDD interface 9 while the musical piece is being recorded.

The digital audio data from A/D converter 2 is stored in delay memory 11*a* for delaying the digital audio data by a time length equivalent to a time needed for DSP 7 to perform its process. Concurrently, audio power calculator 71 in DSP 7 calculates the audio power equivalent to the audio signal level, or a value by raising the value representing the amplitude of the audio signal to the second power.

Cut point detector 72 in DSP 7 detects, as a cut point, a timing at which the amount of change in the audio signal level is large, or a timing at which the amount of change in the audio signal level is not smaller than the predetermined value. Thus, an output from the detection is outputted. Concurrently, the time information and the amount of change at the cut point are stored in temporary storage memory 11*c*.

Figure 3A:
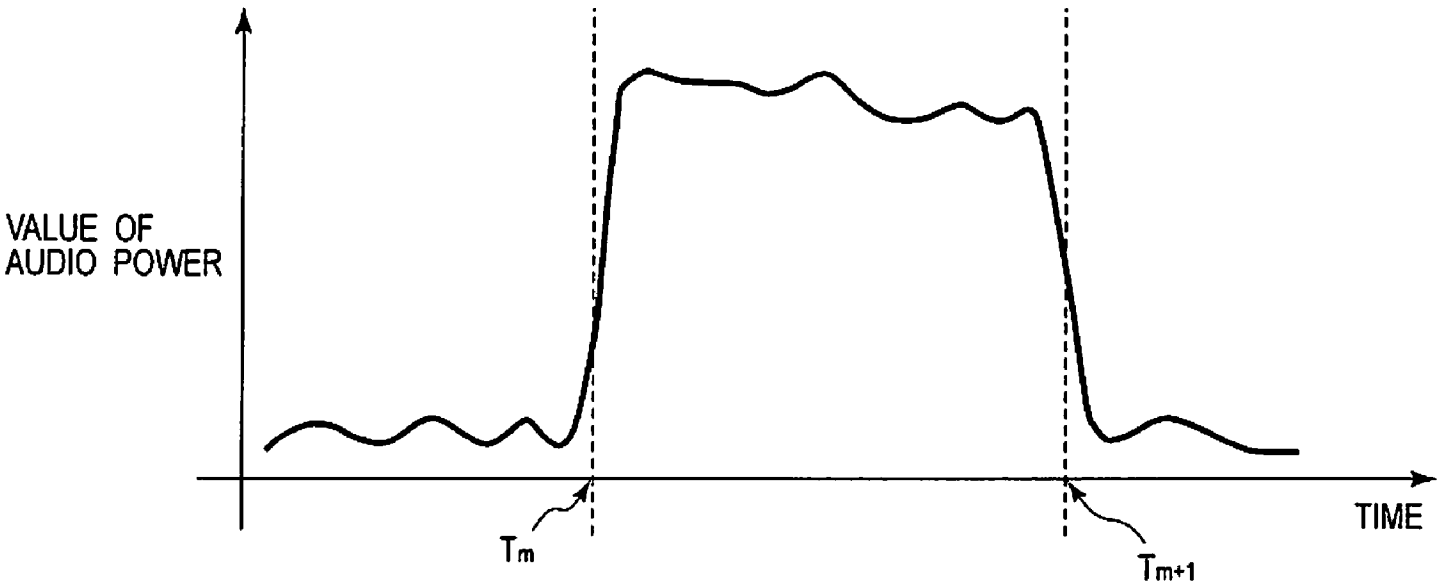
FIGS. 3A and 3B are waveform diagrams each illustrating how a cut point detector operates.
Figure 3B:
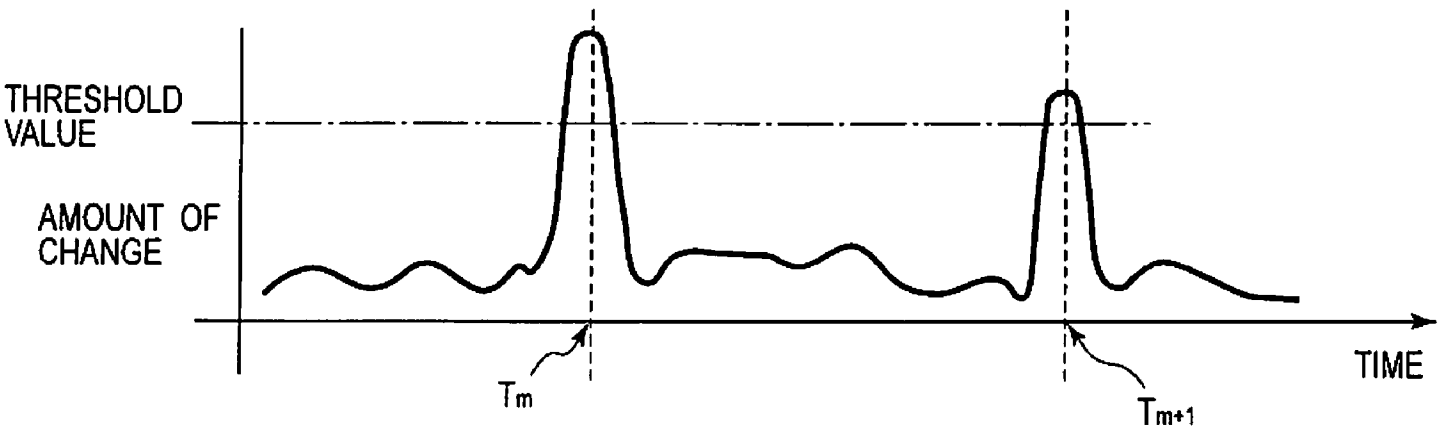

FIGS. 3A and 3B are waveform diagrams each illustrating how cut point detector 72 operates. FIG. 3A shows how the audio power changes, and FIG. 3B shows how the amount of change (differential value) changes. As shown in FIGS. 3A and 3B, on the basis of the value representing the audio power calculated by audio power calculator 71, cut point detector 72 detects, as cut points, times Tm and Tm+1 at which the differential value becomes a local maximum point exceeding a predetermined threshold value. Thereafter, a result of the detection is inputted to frequency characteristic amount calculator 73.

Frequency characteristic amount calculator 73 synchronizes the audio data, which is outputted from delay memory 11*a* with delay by the predetermined time, with the output from cut point detector 72. Then, in a very short period of time between a timing slightly preceding a cut point and a timing slightly delayed from the cut point, the calculator 73 temporarily calculates the characteristic amount of the frequency, such as the MFCC. Then, the result is inputted to likelihood calculator 74.

In the present embodiment, it is taken into consideration that the characteristic amount of the frequency of the musical piece is different from that of the speech. For this reason, a characteristic amount of the frequency typical of the musical piece and that of the speech are both stored in external memory 11*b* beforehand as reference data used for comparison between the characteristic amounts of the frequencies. As a result, likelihood detector 74 in the DSP calculates the likelihood between the reference data and the output representing the result of the calculation of the characteristic amount at each cut point and in its proximity, which output is received from frequency characteristic amount calculator 73. Thereafter, likelihood detector 74 inputs an output representing the calculated likelihood to cut point judging unit 81 in CPU 8.

It should be noted that the calculated characteristic amount of the frequency does not have to be compared with the reference data. Specifically, in addition to the foregoing method of calculating the likelihood of the musical piece through comparing the calculated characteristic amount of the frequency with the reference data, another applicable method calculates the likelihood of the musical piece through assigning the characteristic amount of the frequency to an evaluation function set up beforehand.

Subsequently, cut point judging unit 81 judges whether the audio signal at the cut point belongs to the music or the speech on the basis of the output of the calculated likelihood. A result of the judgment is additionally stored in temporary storage memory 11*c*, in which the time information and the amount of change at the cut point which are received from the cut point detector 72 are already stored, with the result of the judgment associated with the time information and the amount of change at the cut point.

FIG. 4 shows a table of temporary storage memory 11*c* which stores the result of the judgment in association with the time information and the amount of change at the cut point.

Time length judging unit 83 judges whether the audio judged, by cut point judging unit 81, as belonging to the music section lasts for a predetermined time length or longer. Time length judging unit 83 judges that the section is not a musical piece when the music section lasts shorter than the predetermined time length. In the case shown in FIG. 4, for instance, sections judged as the musical pieces by cut point judging unit 81 are those corresponding to times T2, T3, T4, T6, T8 and T9. In this respect, consecutive sections corresponding to times T2, T3, T4 which are judged as the musical pieces are regarded as a single musical piece; an isolated section corresponding to time T6 is regarded as another musical piece; and consecutive sections corresponding to times T8 and T9 which are judged as the musical pieces are regarded as yet another musical piece. Then, time length judging unit 83 judges whether each of these three sections lasts for the predetermined length time or longer. In this example, if the time T6 is shorter than the predetermined time length, time length judging unit 83 judges that the section corresponding to time T6 is not a musical piece. In other words, when one or more sections are judged as musical pieces with the sections between sections judged as no musical pieces, time length judging unit 83 judges whether or not the total time length of the one or more sections interposed in between is not shorter than the predetermined time length. If the total time length is shorter than the predetermined time length, time length judging unit 83 judges that the one or more sections interposed in between are not musical pieces. In this respect, the predetermined time length may be set at 100 seconds in order for time length judging unit 83 to make the judgment on the music section. However, the predetermined time length is not necessarily limited to 100 seconds.

As a result, in the case where the time interval between two neighboring sampling points in the speech is shorter than 100 seconds, even if a sampling point between the two sampling point is judged as a musical piece, time length judging unit 83 is designed not to judge the section between the two neighboring sampling points as a musical piece. The time interval between two neighboring sampling points judged as a speech or anything but a musical piece is measured, and a corresponding section which is not shorter than 100 seconds is judged as a musical piece.

It is empirically learned that a musical piece lasts more than 100 seconds. Accordingly, in the case where the time interval between two neighboring sampling points in a speech is shorter than 100 seconds, even if a sampling point between the two neighboring points may be judged as a musical piece, time length judging unit 83 is designed to judge the corresponding section as no musical piece. Time length judging unit 83 is designed to measure the time interval between two neighboring sampling points judged as a speech or anything but a musical piece, and to judge a corresponding section which is more than 100 seconds as a musical piece.

Music section detector 82 receives an output of the judgment which is obtained from time length judging unit 83, and thus rewrites the table in temporary storage memory 11*c*, accordingly changing an existing table to a table (final table) for each musical piece.

FIG. 5 is a diagram showing a final table obtained by rewriting an existing table in temporary storage memory 11*c*. The final table shows that time T6 is removed from the table, even though time T6 is once judged as a musical piece. This is because time T6 is regarded as no musical piece on the basis that the time length between its preceding time T5 and its subsequent time T7 both judged as a speech is shorter than the predetermined time length.

When the recording operation is completed, this final table is supplied to HDD interface unit 9 via music section detector 82, and is subsequently stored in HDD 10.

It should be noted that each final table is stored in HDD 10 with a start point, an end point, cut points, and amounts of change left for a corresponding musical piece. These are all used to play back the chorus of the musical piece when the musical piece is going to be played back.

Out of encoded data stored in HDD 10, only parts corresponding to music sections specified in the final table are sequentially read out in accordance with editing and playback operations, and are thus inputted into MP3 codec 3. MP3 codec 3 decodes the corresponding parts in the encoded data. Subsequently, the decoded parts are converted to the audio signal by D/A converter 4, and are thus outputted from speaker 5. This makes it possible to detect only the musical piece from the audio signal including speech sections and the like, as well as accordingly to extract and play back the musical piece.

The present embodiment makes it possible to precisely detect the musical piece, because the music sections are detected by use of both information on the cut points and information on the amounts of characteristic of the respective frequencies.

Furthermore, the present embodiment also makes it possible to detect the music sections though the arithmetic process entailing only a light workload, because the music sections are detected by calculating the characteristic amount in the frequency area of the audio signal only at each cut point and in its proximity.

In the present embodiment, DSP 7 is designed to implement its own function whereas CPU 8 is designed to implement its own function. However, the present embodiment is not necessarily limited to the function division therebetween. The two functions may be implemented by CPU 8 only. Otherwise, the present embodiment may have a configuration in which, through software process, CPU 8 implements the functions respectively of A/D converter 2, MP3 codec 3 and D/A converter 4 in addition to the function of DSP 7. Although delay memory 11*a*, external memory 11*b* and temporary storage memory 11*c* have been discretely shown in the foregoing example, the memories are formed in memory 11 shown in FIG. 1.

In the case of the foregoing example, the apparatus detects the music sections while recording the musical piece, so that the apparatus creates and records the final table. Instead, a configuration may be adopted, which causes the apparatus to detect the music sections while sequentially playing back the recorded digital audio data from HDD 10 during an idle time after the apparatus completes recording the musical piece, so that the apparatus creates the final table. Otherwise, a circuit configuration may be adopted, which causes the apparatus to carry out all of the operations according to the foregoing example in linkage with the playback operation. It goes without saying that these configurations are included in the present invention.

In addition, in the foregoing example, the audio signal level is detected as the value obtained by raising a value representing the amplitude of the audio signal to the second power. The audio signal level can be similarly detected as the absolute value of the amplitude, instead.

Moreover, in the foregoing example, the cut point is defined as a timing at which the audio signal level changes to the large extent. As a result, the cut point corresponds to neither the start point nor the end point of the musical piece precisely. However, the cut point can be sufficiently used as the playback start point or the playback end point of the musical piece.

The foregoing example has a configuration effective for a method with which, while editing after recording musical pieces, the operator determines whether or not each of the recorded musical pieces is what the operator wished to have by playing back a part of every recorded musical piece, and leaves only musical pieces which the operator wishes to have as a library afterward. The foregoing example aims at being used regardless of whether or not the editing is carried out precisely.

(Modification)

The music sections may be detected in accordance with the following procedure.

(1) First of all, a characteristic amount of the frequency of an audio signal is calculated. Then, the likelihood between a musical piece and the calculated characteristic amount of the frequency is calculated.

(2) Subsequently, a time point at which a value representing the likelihood exceeds a predetermined value is judged as being a provisional start point of a music section, whereas a time point at which the value representing the likelihood is lower than the predetermined value is judged as being a provisional end point.

(3) Thereafter, a cut point is judged as being a true start point of the music section in a case where the cut point is equal to or close to the provisional start point, whereas a cut point is judged as being a true end point of the music section in a case where the cut point is equal to or close to the provisional end point.

(4) After that, it is assumed that the section from the true start point through the true end point is the music section.

The detection according to the modification makes it possible to increase the precision with which the music section is detected in comparison with the technology, disclosed in Japanese Patent Application Laid-Open Publication No. 2004-258659, for detecting a music section by use of a characteristic amount of the frequency only.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. An apparatus implementing at least recording or playback that detects a music section from an audio signal, comprising:

a cut point detector that detects a time point as a cut point where a level of an audio signal or an amount of change in the audio signal level is equal to or more than a predetermined value;

a frequency characteristic calculator that calculates a characteristic in a frequency domain of the audio signal only at each cut point;

a music section detector that detects a start point and an end point of a music section; and an attribute determining unit that determines whether the audio signal at each cut point belongs to a music section or to a non-music section on a basis of the characteristic calculated by the frequency characteristic calculator; wherein the music section detector presumes that the audio signal between non-music section is a music section, when a time interval between two neighboring non-music section is not shorter than a predetermined length of time.

* * * * *